US005562084A

United States Patent [19]

Shimamura

[11] Patent Number: 5,562,084

[45] Date of Patent: Oct. 8, 1996

[54] DIAGNOSIS CONTROL VALVE UNIT FOR EVAPORATION PURGE SYSTEM

[75] Inventor: Hiroshi Shimamura, Minamisaitama-gun, Japan

[73] Assignee: Kyosan Denki Co., Ltd., Tokyo, Japan

[21] Appl. No.: 460,157

[22] Filed: Jun. 2, 1995

[30] Foreign Application Priority Data

Aug. 8, 1994 [JP] Japan ..... 6-204149

[51] Int. Cl.[6] ..... F02M 33/02

[52] U.S. Cl. ..... 123/520; 123/516

[58] Field of Search ..... 123/516, 518, 123/519, 520, 521, 458, 198 D

[56] References Cited

U.S. PATENT DOCUMENTS

| | | | |
|---|---|---|---|
| 4,449,506 | 5/1984 | Drutchas | 123/458 |
| 4,628,887 | 12/1986 | Mitchell | 123/516 |
| 4,763,635 | 8/1988 | Ballhause | 123/520 |
| 4,862,856 | 9/1989 | Yokoe | 123/519 |
| 4,986,246 | 1/1991 | de Vive | 123/519 |
| 5,253,629 | 10/1993 | Fornuto | 123/519 |
| 5,337,721 | 8/1994 | Kasuya | 123/519 |
| 5,383,437 | 1/1995 | Cook | 123/198 D |
| 5,429,097 | 7/1995 | Wojts-Saary | 123/520 |
| 5,450,833 | 9/1995 | Denz | 123/516 |

*Primary Examiner*—Carl S. Miller
*Attorney, Agent, or Firm*—Oliff & Berridge

[57] ABSTRACT

A diagnosis control valve unit, provided in a vent pipe extending from a carbon canister, includes an air cleaner casing, an air cleaner filter and a diagnosis control valve substantially contained in the casing. A valve element, a valve seat and valve driving components of the diagnosis control valve are disposed in an internal space of the casing and the filter. The diagnosis control valve is firmly attached to an end of the casing. A valve element and a valve seat of a check valve are optionally provided in the casing, firmly attached to the opposite end of the casing. A vent pipe may be connected to that opposite end of the casing, in place of the check valve. The diagnosis control valve, check valve, or vent may be detachably connected to the casing.

18 Claims, 7 Drawing Sheets

DIAGNOSIS CONTROL VALVE UNIT FOR EVAPORATION PURGE SYSTEM

BACKGROUND OF THE INVENTION

1. Field of the Invention

The present invention relates to a control valve unit for failure diagnosis of an evaporation purge system that conveys fuel evaporation from a fuel tank to a carbon canister via an evaporation passage. The unit supplies the fuel evaporation captured by the carbon canister into an intake passage of an internal combustion engine via a purge passage having a purge control valve.

2. Description of the Related Art

Many evaporation purge systems are known. Such purge systems convey fuel evaporation from a fuel tank to a carbon canister via an evaporation passage and supply the fuel evaporation captured by the carbon canister into an intake passage of an internal combustion engine via a purge passage having a purge control valve.

An example of such evaporation purge systems is illustrated in FIG. 7. A vent passage 41 extending from a carbon canister 40 comprises a diagnosis control valve 42, an air cleaner 43, a check valve 44, and pipes 45, 46, 47, such as hoses, which connect adjacent units in series fashion. The diagnosis control valve 42 comprises an on-off valve and is operated for failure diagnosis of the evaporation purge system. The air cleaner 43 blocks dirt and dust when air is introduced through the vent passage 41. The check valve 44 is opened to draw in clean air from, for example, the trunk compartment, and to release pressure from the carbon canister 40 to the outside via, for example, a tire housing or a cross member.

However, because the carbon canister 40, the diagnosis control valve 42, the air cleaner 43 and the check valve 44 are connected in series by the pipes 45, 46 and 47, this known arrangement is costly and requires a large space and many man hours for installation.

SUMMARY OF THE INVENTION

The present invention is intended to overcome such drawbacks. An object of the invention is to provide an evaporation purge system diagnosis control valve unit whose valve components and the like are disposed in the casing of the air cleaner to reduce the installation space and man hours as well as production costs.

According to one aspect of the present invention, there is provided a diagnosis control valve unit for failure diagnosis of an evaporation purge system that conveys fuel evaporation from a fuel tank to a canister via an evaporation passage. The unit supplies the fuel evaporation captured by the canister into an intake passage of an internal combustion engine via a purge passage having a purge control valve. The diagnosis control valve unit comprises a casing, an air cleaner disposed substantially within the casing, a diagnosis control valve including a valve element, valve driving structure and a valve seat that are disposed substantially inside the casing, and a check valve including a valve element and a valve seat that are disposed substantially inside the casing. The diagnosis control valve is firmly connected to a first end of the casing, and the check valve is firmly connected to a second end of the casing remote from the diagnosis control valve.

According to another aspect of the present invention, a vent passage may be connected to the second end of the casing in place of the check valve.

According to either one of these aspects, at least the diagnosis control valve may be detachably connected to the casing.

According to yet another embodiment of the present invention, there is provided a control valve structure for an evaporation purge system comprising a casing having first and second oppositely oriented ends, an air filter disposed substantially within the casing, and a first valve adjacent the first end, the first valve being disposed substantially between the first and second ends.

In the first aspect of the invention, fuel evaporation is captured by the canister, for example, a carbon canister, and the exhaust air that has passed through the canister is led to the check valve, via the pipes, the diagnosis valve and the air cleaner. The check valve is opened to let out the exhaust air from the air cleaner casing to an appropriate location, such as a tire housing, via a pipe or the like. For releasing the captured fuel from the canister to the engine intake, clean air is introduced from, for example, the trunk room, into the air cleaner casing by the check valve. The clean air is led through the air cleaner and then the diagnosis control valve to the canister. For diagnosis of the evaporation purge system, the diagnosis control valve is opened or closed to communicate the canister with the atmosphere or shut the canister from the atmosphere. In this arrangement, both the diagnosis control valve and the check valve can be disposed in the casing of the air cleaner without employing connecting pipes.

If a vent passage is attached to the casing of the air cleaner in place of the check valve, the diagnosis control valve unit of the evaporation purge system can be further reduced in size. In this arrangement, air from the canister is led out through the same vent passage as used to introduce air to the canister.

If the diagnosis control valve is detachably attached to the air cleaner casing, replacement of the air cleaner is significantly facilitated.

BRIEF DESCRIPTION OF THE DRAWINGS.

Further objects, features and advantages of the present invention will become apparent from the following description of preferred embodiments with reference to the attached drawings in which like reference numbers designate like reference parts, wherein.

DETAILED DESCRIPTION OF PREFERRED EMBODIMENTS

Preferred embodiments of the invention will be described with reference to the attached drawings.

Figure 1:
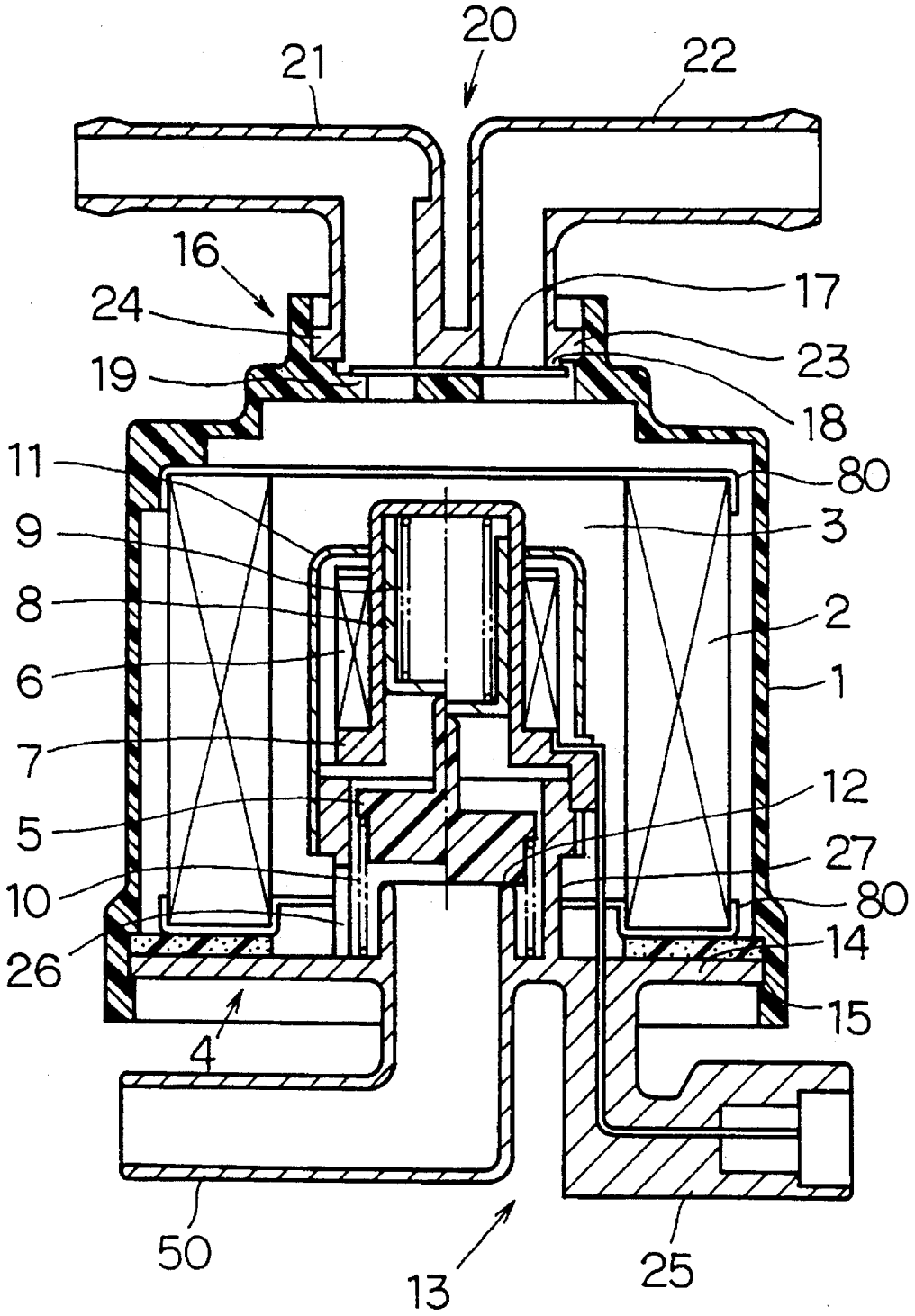
FIG. 1 is a split sectional view of a first embodiment of the evaporation purge system diagnosis control valve unit of the present invention.

Referring to FIG. 1, a diagnosis control valve unit according to the first embodiment comprises an air cleaner casing 1 formed of, for example, synthetic resin or metal. The air cleaner casing 1 contains a tubular air cleaner filter 2 that and loosely fits on the internal peripheral surface of the casing 1. The air cleaner filter 2 has a frame that substantially encloses an interior space 3 of the filter 2. Arranged in the internal space 3 of the filter 2 are several component parts of a diagnosis control valve 4. The internal space 3 includes a valve element 5 and a valve driving mechanism including a coil 6, a coil bobbin 7, a plunger 8, springs 9, 10 and a yoke 11. A valve seat 12 is also formed at an end of a first cap 13. The other end of the first cap 13 is connected to a vent hole of a canister (not shown), for example, a carbon canister, via a pipe 50 or the like. The first cap 13 has a flange 14 that is firmly connected to one end of the casing 1 using a snap fitting 15.

Provided at the opposite end of the casing 1, inside the casing 1, is a check valve 16 comprising a valve element 17 and valve seats 18, 19 that are formed on an end of a second cap 20. More specifically, the second cap 20 has two pipes 21, 22 whose ends form the valve seats 19 and 18, respectively. The pipe 21 is connected at its other end to a tire housing (not shown) or the like, via a pipe or the like. The other pipe 22 is connected at its other end to the trunk compartment (not shown) or the like, via a pipe or the like. The second cap 20 also has a flange 23 that is firmly connected to the other end of the casing 1 using a snap fitting 24, the end being remote from the first cap 13.

The flange 14 of the first cap 13 has an electric connector 25 and a cylindrical portion 27 protruding therefrom to the outside and inside of the casing 1, respectively. The electric connector 25 is connected to an external power source (not shown) to energize the coil 6. The cylindrical portion 27 has an opening 26 for communicating air between the filter 2 and the valve element 5, which is located inside the cylindrical portion 27.

To lead fuel evaporation from the fuel tank (not shown) to the carbon canister, or to release the fuel from the carbon canister and convey the released fuel evaporation to the intake passage, the diagnosis control valve 4 is opened. More specifically, the coil 6 is energized by electricity from the connector 25. Thereby, the plunger 8 is forced to move upward against the elastic restoration force of the spring 9, allowing the valve element 5 to be lifted off the valve seat 12 by the elastic restoration force of the spring 10, as shown in the lefthand portion of FIG. 1.

During the operation to capture fuel evaporation with the carbon canister, the exhaust air from the carbon canister (containing a small amount of escaping fuel evaporation captured by the carbon canister) is led from the vent hole of the carbon canister to the cap 13 via the pipe 50 or the like. The exhaust air flows through the opening 26 of the cylindrical portion 27 and through the air cleaner filter 2 from the inside to the outside thereof. The exhaust air from the outside of the filter 2 pushes open the valve element 17 of the check valve 16 to flow into the pipe 21. The exhaust air is then let out from the tire housing or the like.

During the operation to release fuel evaporation from the carbon canister, clean air from the trunk compartment or the like is introduced into the air cleaner casing 1, via the pipe 22 of the second cap 20, with the valve element 17 of the check valve 16 opened for the pipe 22. The clean air passes through the filter 2 from the outside to the inside thereof, and flows through the opening 26 of the diagnosis control valve 4 into the pipe 50 of the first cap 13. The clean air is thus led to the carbon canister.

For failure diagnosis of the evaporation purge system, the diagnosis control valve 4 is turned on and off to selectively communicate the carbon canister with the atmosphere.

According to this embodiment, the diagnosis control valve 4 is attached into the air cleaner casing 1 by firmly connecting its flange 14 to one end of the casing 1 using the snap fitting 15, so that most of the component parts of the diagnosis control valve 4 are contained in the internal space 3 of the air cleaner filter 2. The check valve 16 is also provided substantially inside the air cleaner casing 1, by firmly connecting it to the opposite end thereof remote from the diagnosis control valve 1, using the snap fitting 24. The diagnosis control valve 4 and the check valve 16 are thus arranged inside the air cleaner casing 1 without using connecting pipes therebetween. Therefore, this arrangement reduces the space and man hours required for installation and reduces costs of production and assembly.

Figure 2:
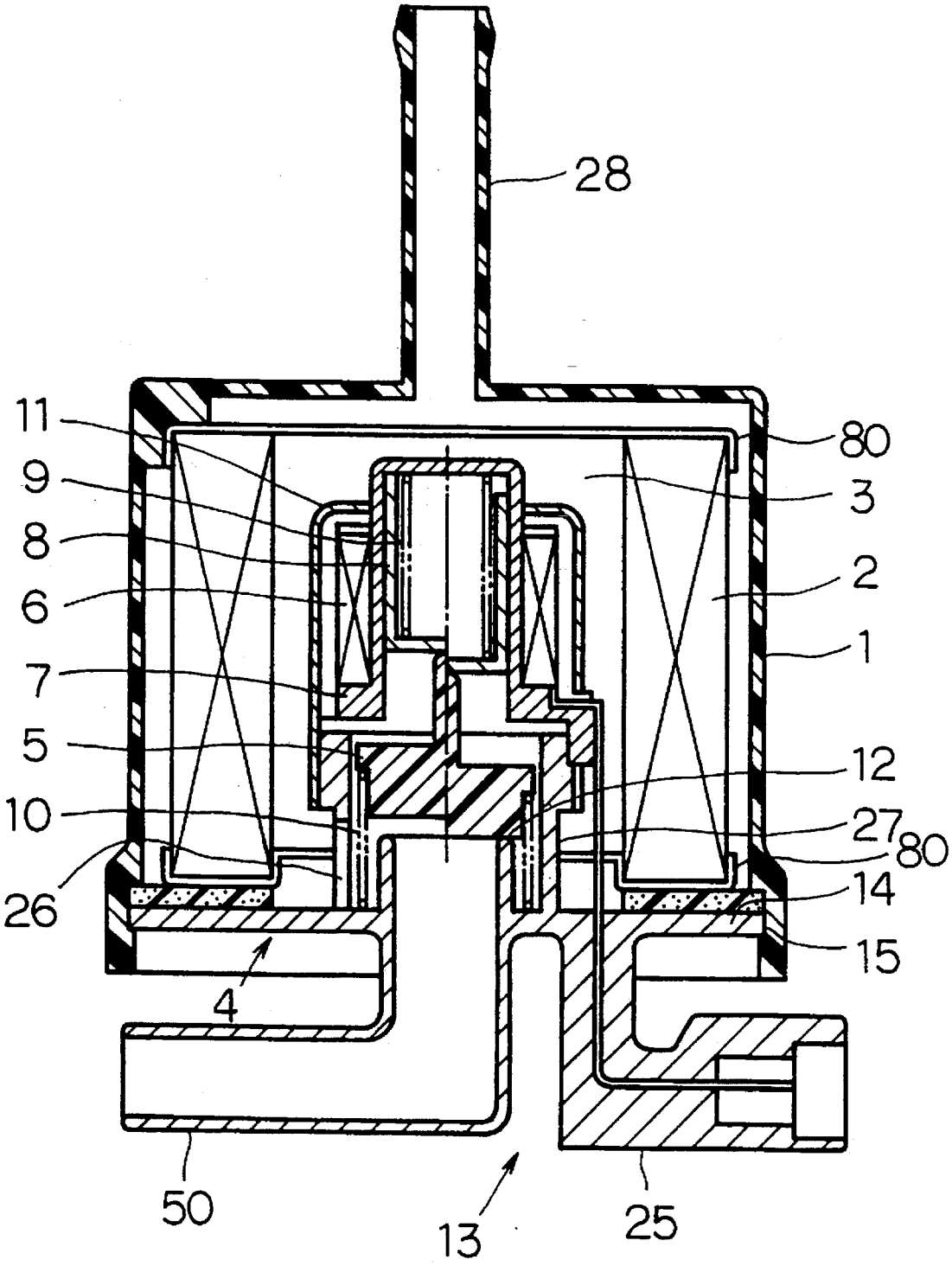
FIG. 2 is a split sectional view of a second embodiment of the evaporation purge system diagnosis control valve unit of the present invention.

With reference to FIG. 2, a second embodiment will be described. Unlike the first embodiment, the second embodiment does not comprise a check valve. Instead, a vent pipe 28 is connected to an end of an air cleaner casing 1, the end being opposite the diagnosis control valve 4. The single vent pipe 28 is used for two purposes: to supply air from the outside to the carbon canister; and to lead the exhaust air from the canister to the outside. Other component parts are constructed and arranged in substantially the same manner as in the first embodiment. Such parts are denoted in FIG. 2 by numerals comparable to those in FIG. 1, and will not be described again.

Figure 3:
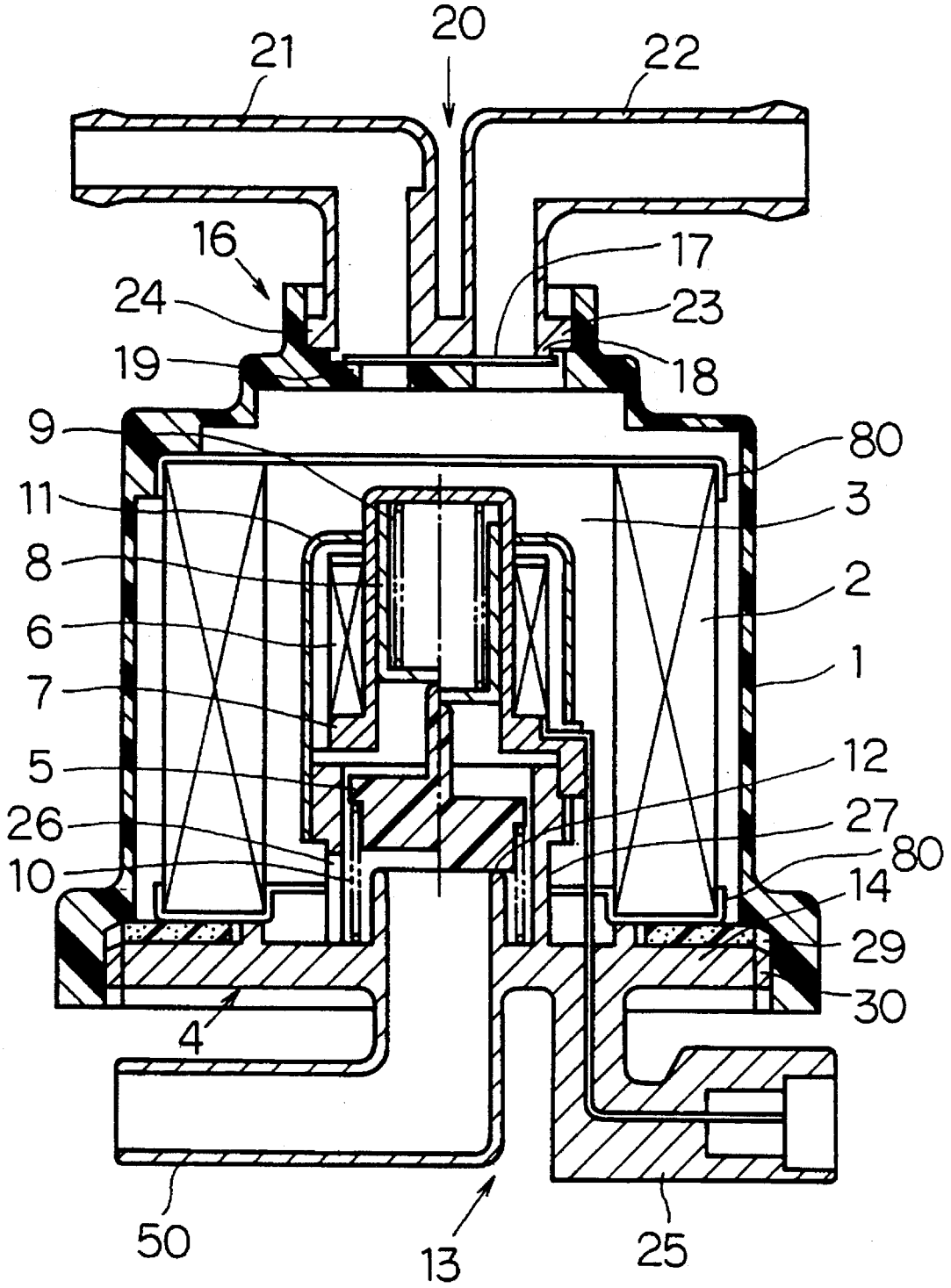
FIG. 3 is a split sectional view of a third embodiment of the evaporation purge system diagnosis control valve unit of the present invention.

With reference to FIG. 3, a third embodiment will be described. The cap 13 of the diagnosis control valve 4 is fastened to an end of an air cleaner casing 1 using threads 30, 29 that are respectively formed on the peripheral edge of the flange 14 of the cap 13 and the inner peripheral surface of the end portion of the casing 1, instead of the snap fitting employed in the first embodiment. The threads 29, 30 facilitate attaching the diagnosis control valve 4 into the casing 1 and detaching it therefrom, enabling easy replacement of the air cleaner filter 2 disposed in the casing 1. Other component parts are constructed and arranged in the same manner as in the first embodiment. Such parts are denoted in FIG. 3 by numerals comparable to those in FIG. 1, and will not be described again.

Figure 4:
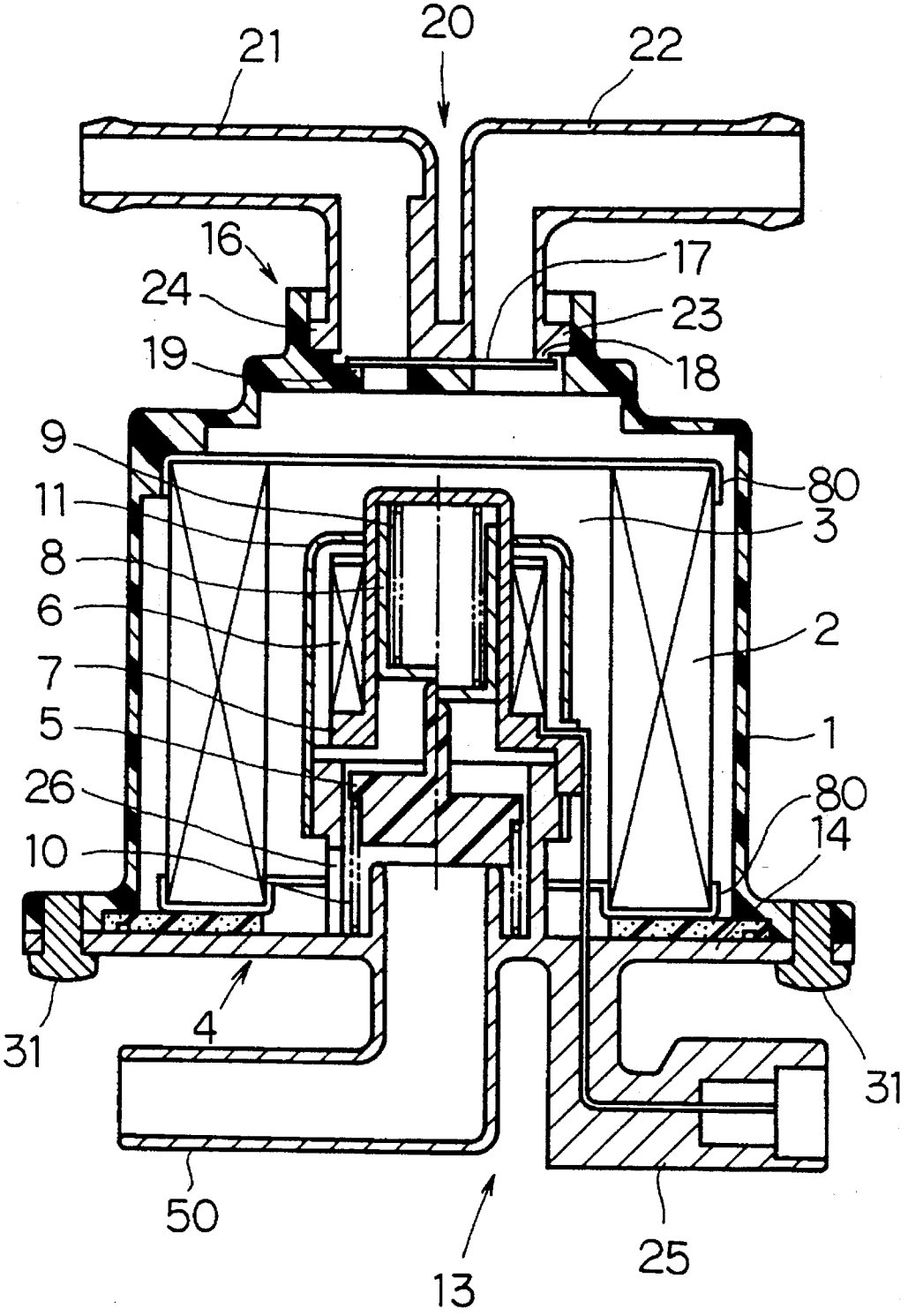
FIG. 4 is a split sectional view of a fourth embodiment of the evaporation purge system diagnosis control valve unit of the present invention.

A fourth embodiment will be described with reference to FIG. 4. Instead of the snap fitting employed in the first embodiment, a plurality of screws 31 are used to fasten the cap 13 of the diagnosis control valve 4 to an end of the air cleaner casing 1. The end of the casing 1 is flanged so as to adapt to screwing thereto of a peripheral portion of the flange 14 of the cap 13 using the screws 31. This screw-fastening arrangement facilitates attaching the diagnosis control valve 4 into the casing 1 and detaching it therefrom, enabling easy replacement of the air cleaner filter 2 disposed in the casing 1. Other component parts are constructed and arranged in the same manner as in the first embodiment. Such parts are denoted in FIG. 4 by numerals comparable to those in FIG. 1, and will not be described again.

Figure 5:
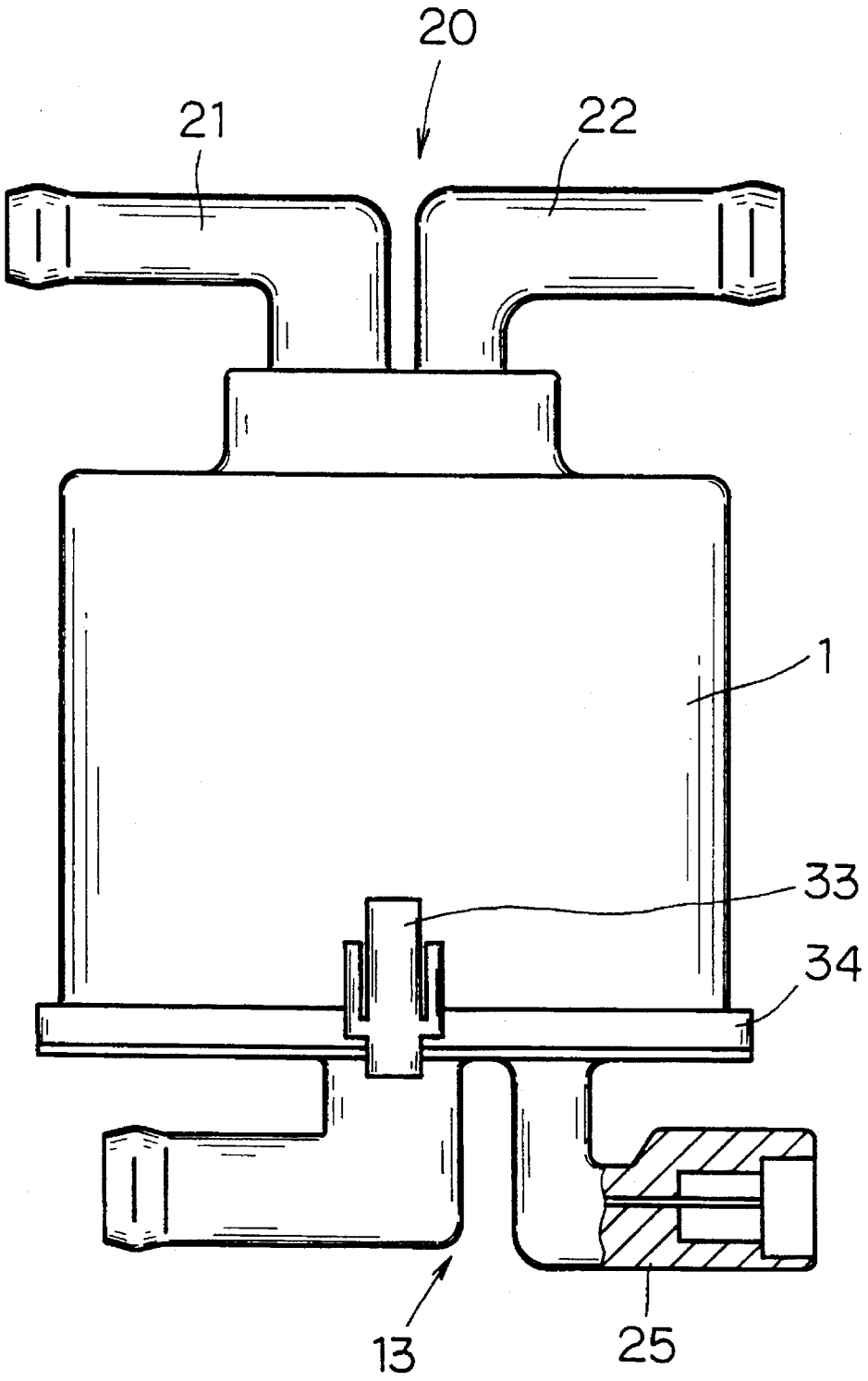
FIG. 5 illustrates a fifth embodiment of the evaporation purge system diagnosis control valve unit of the present invention.
Figure 6:
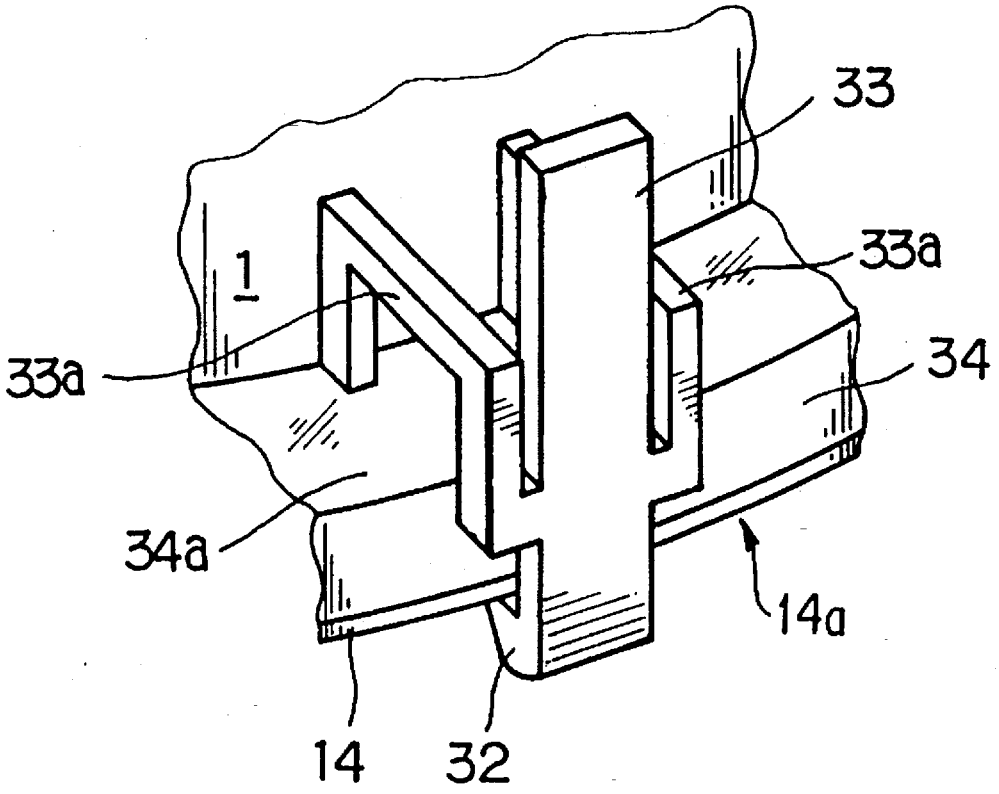
FIG. 6 is an enlarged perspective view of a portion of FIG. 5.
Figure 7:
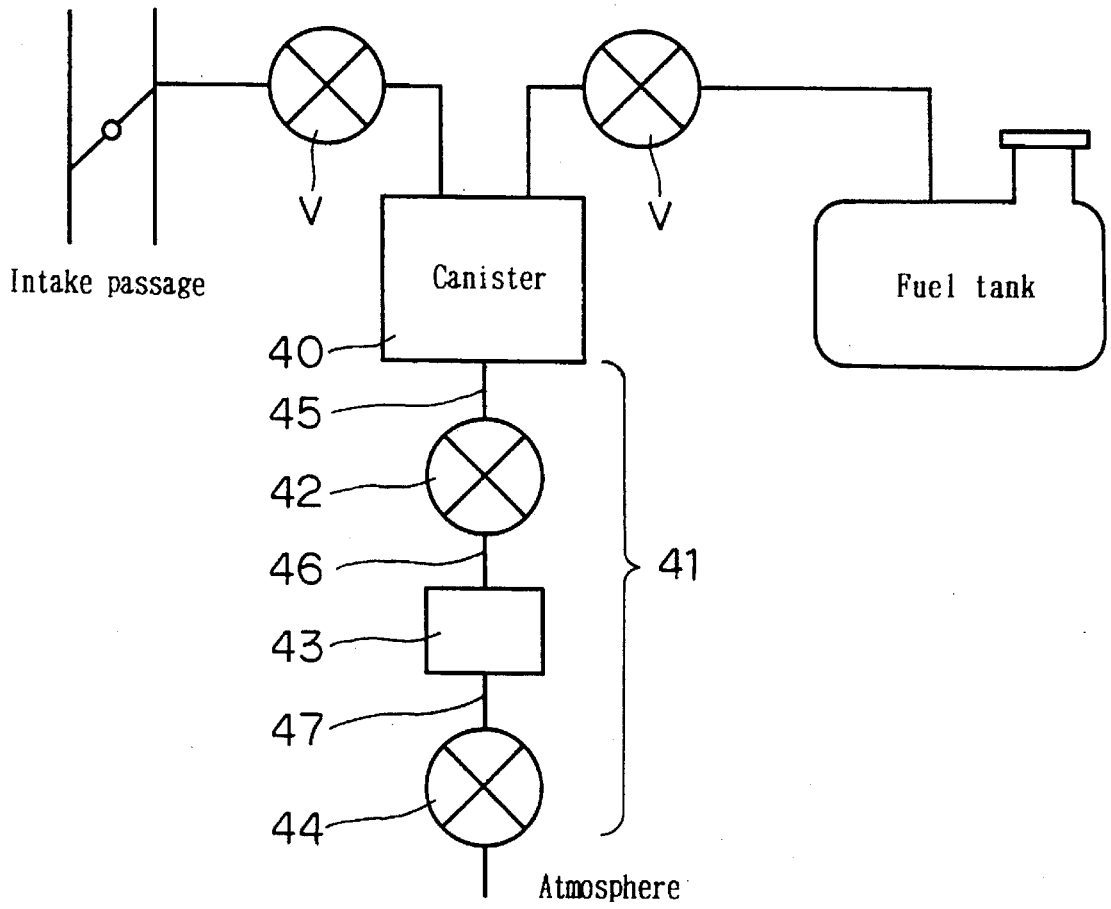
FIG. 7 illustrates an evaporation purge system.

A fifth embodiment will be described with reference to FIGS. 5 and 6. Instead of the snap fitting employed in the first embodiment, a plurality of retaining lugs 33 are provided on the outer peripheral surface of a lower end portion of the air cleaner casing 1 to retain the cap 13 of the diagnosis control valve 4. Each of the retaining lugs 33 has resilient arms 33*a* that are fixed to or formed together with the air cleaner casing 1. The casing 1 has at its lower end a flange 34 that abuts the retaining lugs 33. Each of the retaining lugs 33 extends downward beyond (or protrudes downward from) the flange 34 of the casing 1 and has a hook 32 at its lower end. The cap 13 is retained to the flange 34 of the casing 1 by the hooks 32 of the lugs 33 hooking on a bottom surface 14*a* of the peripheral edge of the flange 14 of the cap 13. The retaining lugs 33 thus facilitate attaching the diagnosis control valve 4 into the casing 1 and detaching it therefrom, enabling easy replacement of the air cleaner filter 2 disposed in the casing 1. Although, according to this embodiment, the retaining lugs 33 are fixed to the casing 1, the retaining lugs may be fixed to the cap 13 and separate from the casing 1 so that the hooks thereof hook on an upper surface 34*a* of the flange 34 of the casing 1. The retaining lugs may also be separate from both the casing 1 and the cap 13. Other component parts are constructed and arranged in the same manner as in the first embodiment. Such parts are denoted in FIGS. 4 and 5 by numerals comparable to those in FIG. 1, and will not be described again.

Although various means for attaching the diagnosis control valve into the air cleaner casing have been disclosed in connection with the above embodiments, the attaching means are not limited to the above disclosed means. It should be understood that the present invention may employ other attaching means to attach the diagnosis control valve 4 into the casing 1.

According to the present invention, the diagnosis control valve is disposed inside the air cleaner casing by firmly connecting it to an end of the casing, so that most of the component parts of the diagnosis control valve, for example, the valve element, the valve seat and the valve driving mechanism components, are contained in the internal space of the air cleaner filter. The component parts of the check valve, for example, the valve element and the valve seat thereof, may also be provided substantially inside the air cleaner casing, by firmly connecting the check valve to the opposite end thereof remote from the diagnosis control valve. The diagnosis control valve and the check valve can thus be arranged inside the air cleaner casing without using connecting pipes therebetween. Therefore, this arrangement reduces the space and man hours required for installation and reduces costs for production and assembly.

Furthermore, if a vent pipe is attached to the air cleaner casing in place of the check valve, the size of the entire diagnosis control valve unit of the evaporation purge system can be further reduced.

Still further, if the diagnosis control valve is detachably attached to the air cleaner casing, the air cleaner filter can be easily replaced.

While the present invention has been described with reference to what are presently considered to be preferred embodiments, it is to be understood that the invention is not limited to the disclosed embodiments. To the contrary, the invention is intended to cover various modifications and equivalent arrangements included within the spirit and scope of the appended claims.

What is claimed is:

1. A diagnosis control valve unit for failure diagnosis of an evaporation purge system that conveys fuel evaporation from a fuel tank to a canister via an evaporation passage, the diagnosis control valve unit supplying the fuel evaporation captured by the canister into an intake passage of an internal combustion engine via a purge passage having a purge control valve, the diagnosis control valve unit comprising:

a casing having first and second ends defining an internal space therebetween;

an air cleaner disposed substantially within said internal space;

a diagnosis control valve including a valve element, a valve driver and a valve seat that are disposed substantially inside said internal space, the diagnosis control valve being firmly connected to the first end of the casing; and a check valve including a valve element and a valve seat that are disposed substantially inside the casing, the check valve being firmly connected to the second end of the casing, remote from the diagnosis control valve.

2. A control valve unit according to claim 1, wherein at least the diagnosis control valve is detachably connected to the casing.

3. A diagnosis control valve unit for failure diagnosis of an evaporation purge system that conveys fuel evaporation from a fuel tank to a canister via an evaporation passage, the diagnosis control valve unit supplying the fuel evaporation captured by the canister into an intake passage of an internal combustion engine via a purge passage having a purge control valve, the diagnosis control valve unit comprising:

a casing having first and second ends defining an internal space therebetween;

an air cleaner disposed substantially within the internal space;

a diagnosis control valve including a valve element, a valve driver and a valve seat that are disposed substantially inside said internal space, the diagnosis control valve being firmly connected to the first end of the casing; and a vent passage connected to the second end of the casing, remote from the diagnosis control valve.

4. A control valve unit according to claim 3, wherein at least the diagnosis control valve is detachably connected to the casing.

5. A control valve structure for an evaporation purge system comprising:

a casing having first and second oppositely oriented ends defining an internal space therebetween;

an air filter disposed substantially within said internal space; and a first valve adjacent said first end, said first valve being disposed substantially between said first and second ends in said internal space.

6. A control valve structure for an evaporation purge system comprising:

a casing having first and second oppositely oriented ends;

an air filter disposed substantially within said casing; and a first valve adjacent said first end, said first valve being disposed substantially between said first and second ends, wherein said first valve is positioned within said air filter.

7. A control valve structure for an evaporation purge system comprising:

a casing having first and second oppositely oriented ends;

an air filter disposed substantially within said casing;

a first valve adjacent said first end, said first valve being disposed substantially between said first and second ends; and a second valve adjacent said second end, said second valve being disposed substantially within said casing.

8. A control valve structure according to claim 7, wherein said second valve selectively communicates said air filter with one of an exhaust pipe and a clean air supply pipe.

9. A control valve structure according to claim 5, further comprising a vent pipe that conveys exhaust air from said casing and provides said casing with outside air.

10. A control valve structure for an evaporation purge system comprising:

a casing having first and second oppositely oriented ends:

an air filter disposed substantially within said casing; and a first valve adjacent said first end, said first valve being disposed substantially between said first and second ends, wherein said first valve is mounted on a valve seat of a first cap detachably connected to said first end.

11. A control valve structure according to claim 10, wherein said first cap and said first end are detachably connected using a snap fitting.

12. A control valve structure according to claim 10, wherein said first cap and said first end are detachably connected using mating threads of said first end and said first cap.

13. A control valve structure according to claim 10, wherein said first cap and said first end are detachably connected using at least one screw member and at least one hole defined in both a flanged end of said first end and said first cap.

14. A control valve structure according to claim 10, wherein said first cap and said first end are detachably connected using at least one retaining lug.

15. A control valve structure according to claim 14, wherein said retaining lug includes a hook that contacts at least one of a bottom surface of said first cap and an upper surface of a flange of said first end of said casing.

16. A control valve structure according to claim 10, further comprising a second valve detachably connected to said second end.

17. A control valve structure according to claim 16, wherein said first cap and said first end are detachably connected using a snap fitting.

18. A control valve structure for an evaporation purge system comprising:

a casing having first and second oppositely oriented ends:

an air filter disposed substantially within said casing; and a first valve adjacent said first end, said first valve being disposed substantially between said first and second ends, wherein said first end includes a first pipe that communicates with a canister, said first valve controlling communication between said canister and said air filter, said canister also communicating with a fuel tank and an engine intake to convey fuel vapor from said fuel tank to said engine intake and to convey exhaust air from said fuel tank to the atmosphere.

* * * * *